United States Patent [19]

Buhrke

[11] 4,106,422

[45] Aug. 15, 1978

[54] METHOD FOR MANUFACTURE OF CAN END CLOSURES

[75] Inventor: Fred W. Buhrke, Arlington Heights, Ill.

[73] Assignee: Buhrke Industries, Inc., Arlington Heights, Ill.

[21] Appl. No.: 776,949

[22] Filed: Mar. 14, 1977

[51] Int. Cl.[2] ..... B21D 51/44

[52] U.S. Cl. ..... 113/121 C; 113/116 V; 113/116 Y

[58] Field of Search ..... 113/121 C, 116 V, 116 Y, 113/116 BB, 1 F, 121 R; 83/41

[56] References Cited

U.S. PATENT DOCUMENTS

| | | | |
|---|---|---|---|
| 2,378,041 | 6/1945 | Sebell | 113/116 V |
| 2,648,380 | 8/1953 | Socke | 83/41 |
| 3,739,623 | 6/1973 | Kramer | 113/116 V |
| 3,366,086 | 1/1968 | Fraze | 113/121 C |
| 3,888,199 | 6/1975 | Herrmann | 113/121 C |

*Primary Examiner*—Michael J. Keenan
*Attorney, Agent, or Firm*—Chas. W. Rummler

[57] ABSTRACT

The method of making convenience opened can end closures or can tops from a metallic web of coil stock which comprises the steps of piercing, marginally notching, and lancing the web according to a predetermined pattern at longitudinally spaced intervals to define a series of identical individual can top blanks which are part of a web layout in which said blanks are connected together by flexible links and are spaced apart on equal centers, and then passing the thus prepared web over the necessary stations of a single progressive die operated by a single press to complete the drawing and embossing of each web blank to form a can top therein while the web material acts as the carrier of the blanks until the can tops are cut out of the web to be transferred individually to edge curling and finishing stations comprised within the said progressive die.

12 Claims, 17 Drawing Figures

POSITION 5

POSITION 6

POSITION 7

POSITION 8

POSITION 9

POSITION 10

POSITION 16

POSITION 17

POSITION 18

METHOD FOR MANUFACTURE OF CAN END CLOSURES

BACKGROUND OF THE INVENTION

Heretofore can tops, or can end closures, have been made from metal discs cut from coil stock and then individually carried through a progressive die by a transfer mechanism which in regular order moves the separate discs from station to station for the necessary forming operations. This not only requires expensive and complicated apparatus for handling the individual pieces but is also slow in its output of finished can tops and often wasteful of the material from which the can tops are made.

A step in the direction of improving the manufacturing process for producing can tops is described in U.S. Pat. No. 3,888,199 which discloses a method for making a "press tab" or "button down" type of container end from a metallic web wherein the preliminary steps of forming and lancing the tabs or buttons are performed on the web at uniformly spaced areas comprising a predetermined web layout for batches of can ends. With the method of this patent, however, the preformed areas are then blanked-out of the web to provide individual can end discs or panels which are thereafter worked individually to produce the finished can ends, for example, in the manner described in U.S. Pat. No. 3,886,881.

The object of the present invention is to further simplify and improve the process of manufacturing easy open can tops, or can end closures, by doing all of the necessary lancing, panel forming, countersinking and embossing steps, except edge curling, while the can top blanks remain as integral parts of the metallic web, which is supplied as coil stock to a progressive die system, and then to do the edge curling by tools embodied in the same progressive die while in the same press.

SUMMARY OF THE INVENTION

The improved method involves certain steps in the preparation of strip form coil stock for the working of successive batches of can end blanks comprising a web layout of parallel lines of can ends whereby all of the forming steps necessary for a finished can end, except the curling of the can end flange, may be performed while the can end blanks remain as integral parts of the web with the center-to-center spacing of the blanks being constant from the first press operation until the finished ends are cut from the scrap strips.

The preparation of the web of coil stock comprises piercing and lancing the web according to a predetermined web layout to establish individual and separate blank areas in each of which a can end is to be formed and to form connecting links which tie all of the blanks together within the original web area. Included in this web preparation is the step of notching and lancing the web margins between contiguous blank areas to provide inwardly arching marginal links between the individual blanks. The legs of these marginal links are then upset from the plane of the web at their juncture with the web margin to allow their being stretched in the longitudinal direction of the web without breaking during the subsequent can end forming operations. It is the connecting links thus formed to hold the blanks together in the web that permit all of the drawing and embossing operations to complete a can end without removal of the blanks from the original web, whereby the web itself serves as a carrier for the blanks as they travel through the progressive die press operations.

DESCRIPTION OF THE DRAWINGS

A specific embodiment illustrating the improved can endforming method of my invention is shown in the accompanying drawings, in which.

DESCRIPTION OF THE PREFERRED EMBODIMENT

My improved method of can end manufacture is illustrated and described herein as though employed to make can ends of the kind illustrated in U.S. Pat. No. 3,886,881 with some improvement of the forming steps comprising the method described therein.

Figure 16:
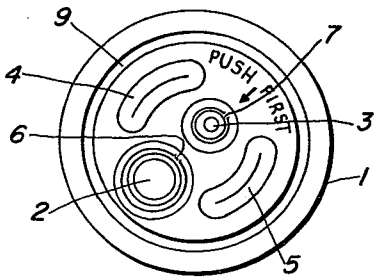
FIG. 16 is a top plan view of a completed can top, as described herein, made by the improved process herein disclosed.

A plan view of a can top made according to my improved process is shown by FIG. 16 on sheet 1 of the drawings and as shown comprises a generally flat panel or plate 1, preferably of aluminum and originally part of the coil stock web 10 (FIG. 1), which has formed therein a pour opening closure "press tab" 2, a vent opening closure "press tab" 3, and a pair of arcuate ridges 4 and 5 disposed one on each side of the aligned vent and pour opening closure tabs. As shown in the sectional view of FIG. 14, which shows the can top in inverted position, the vent and pour opening tabs project above the upper side surface of the plate 1 to facilitate finger pressure opening and the ridges or crescent beads 4 and 5 project beyond the said tabs to protect them against accidental opening when the filled and sealed cans are stacked end to end or in inverted position.

Figure 14:
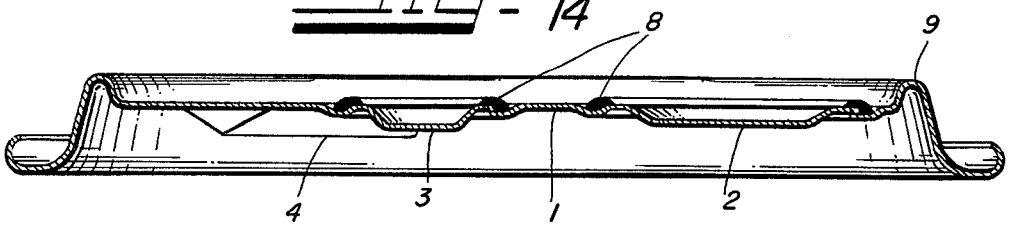
FIG. 14 is a sectional view of the completed can top illustrating the sealing of the lanced portions of the can top panel.

The closure tabs 2 and 3 are initially formed by lancing the plate 1 circumferentially of the button areas, except for small hinge areas 6 and 7, respectively, and subsequently the tabs 2 and 3 are reformed and coined to increase their size so that on the under side of the can end their margins will underlie the margins of the openings in the plate 1 formed by the lancing operation. Thereafter the lanced portions are sealed on the under side of the can end by a suitable, preferably plastic, sealant 8, as shown in FIG. 14.

The primary object of my present invention is to accomplish the complete formation of these can ends or tops, except for edge curling and closure tab sealing, automatically and while they are integral parts of a continuous web of suitable sheet material thereby saving time, material and handling. Because the manufacture of these can tops involves a series of separate drawing and embossing operations in a progressive die, it is essential that the sheet material web be advanced through the system with intermittent steps of precisely equal length and that the center-to-center spacing of the successive blanks comprising the web layout remain precisely the same until the can ends are cut from the carrier web. Also, because each drawing and embossing operation performed on a can end blank, as it passes through the progressive die, requires a generally radial "pulling in" of the blank and a reduction of the plane area of the blank, means must be provided to keep the individual blanks operatively connected or tied to the web and to each other without deviation from the initial predetermined center-to-center relation of the blanks with each other.

This is done, according to my invention, by lancing the web of sheet material according to a predetermined pattern or web layout which not only defines the shape of each blank area but also separates the contiguous blanks from each other except for a narrow and bendable connecting link which extends from each blank to the next adjacent blank.

Figure 1:
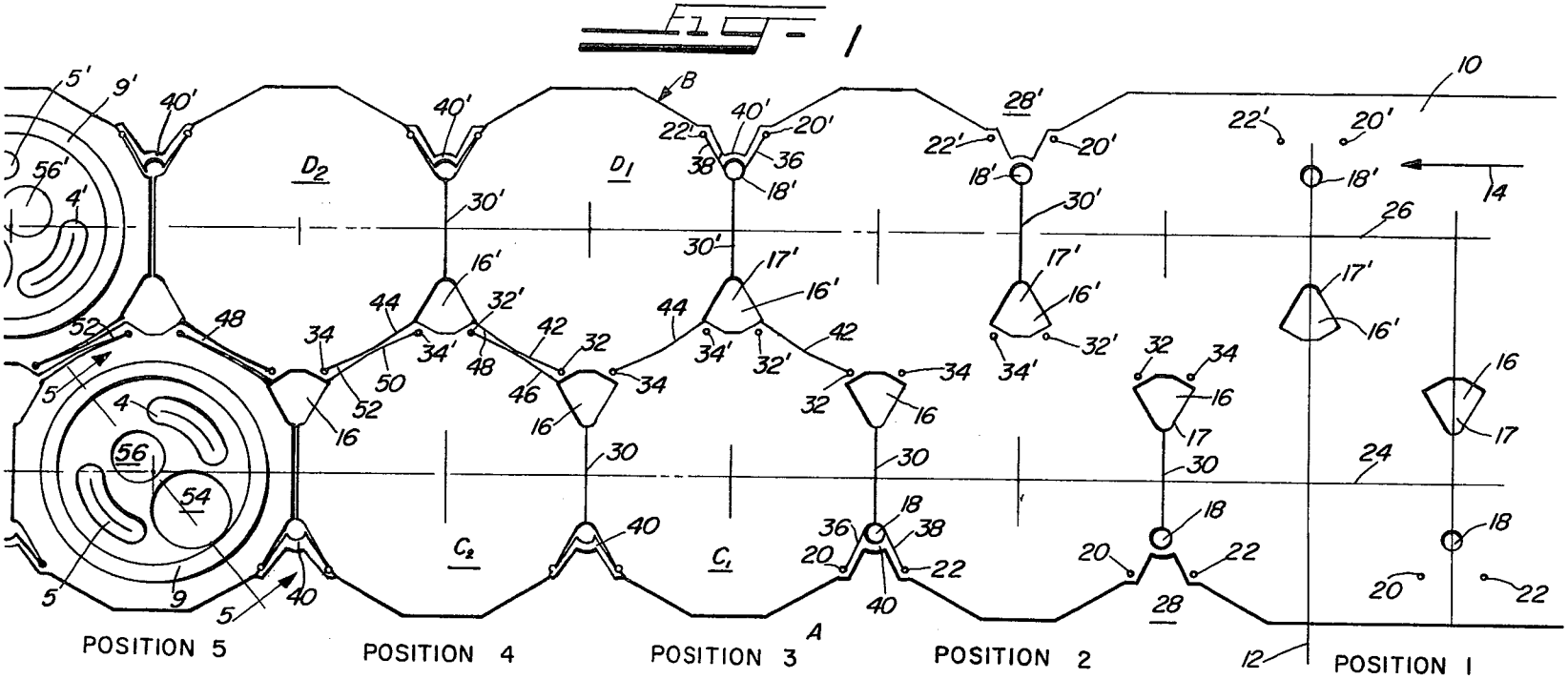
FIG. 1 is a plan view of an enlongated sheet or web of coil stock on which the first five steps for making an easy-open can top or can end according to the method of the present invention are shown on a web layout for two parallel lines of can tops.

As shown by FIG. 1, this lancing of the web of sheet material, or coil stock, is the first and preparatory portion of the process that, generally, should be completed before any can end-forming operation is done. To begin with, the web layout of the blank areas must be planned and the spacing of the blank area centerlines determined for maximum use of the web material. Thus, for the web-layout of the coil stock strip 10, we establish a transverse centerline 12 upon which all blank areas will be based and determined, this centerline marking the center of the first blank area of the left hand row when looking in the direction of web travel as indicated by the arrow 14.

Figure 2:
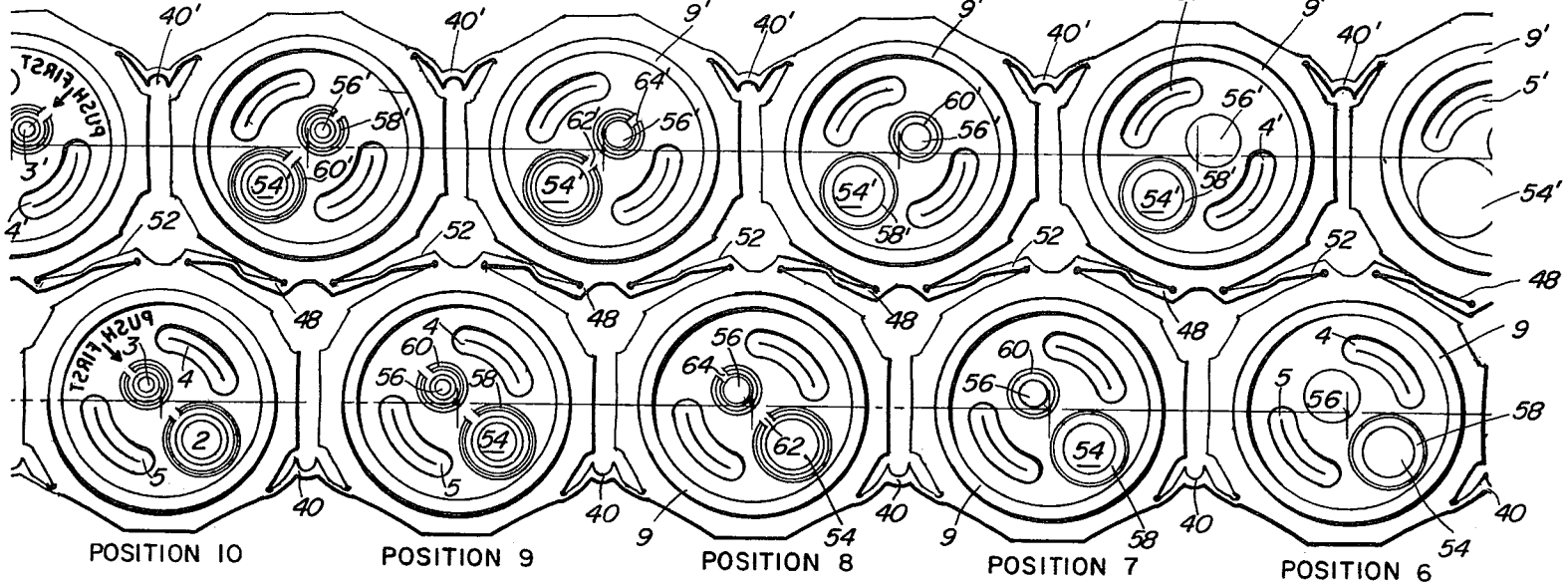
FIG. 2 is a continuation of the web of FIG. 1 showing the next five steps in the formation of the can top and illustrating how the center-to-center relationship of the can top blanks is maintained constant throughout the several forming steps.
Figures 3, 3A:
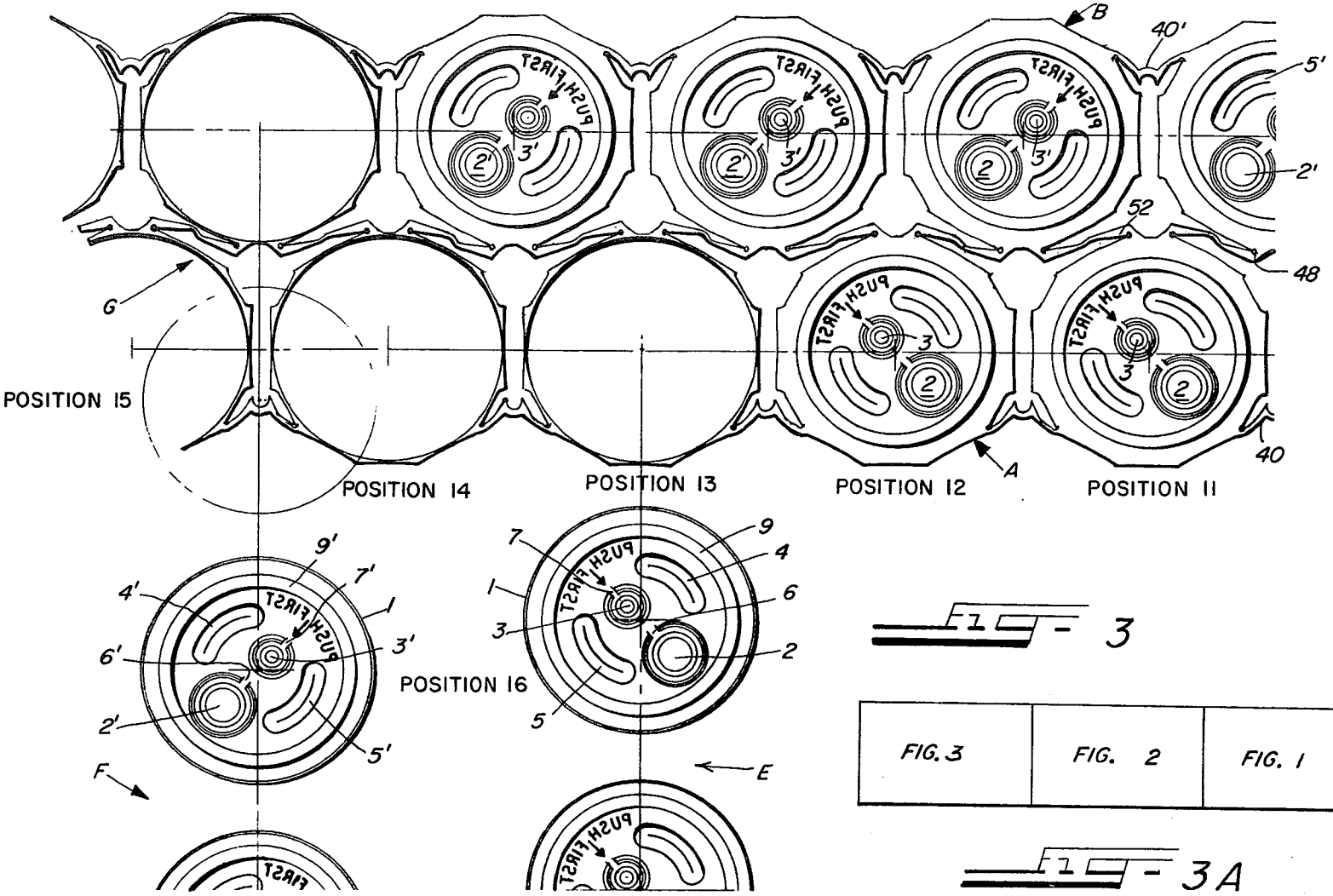
FIG. 3 is a continuation of the web of FIG. 2 illustrating the final operations on the web whereby the can tops of the two lines are cut from the web to be transferred in parallel lines to the edge curling tools of the progressive die.
FIG. 3A is a block diagram showing the relation of FIGS. 1, 2 and 3.
Figure 5:
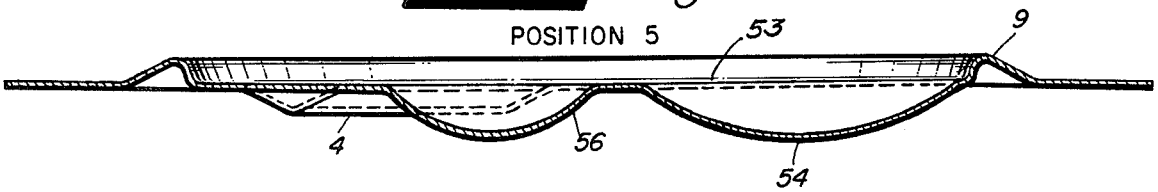
FIG. 5 is a transverse vertical sectional view along the line 5—5 at position 5 of FIG. 1 to illustrate the first draw operation of the improved method by which the blank is formed to provide the can top panel and shape the panel features for the desired easy-open design.

FIGS. 1, 2 and 3 illustrate a two-row web layout of blank areas and show the successive progressive die operations that are performed on each blank area to complete the punching and lancing steps and prepare the respective blank for the drawing and embossing steps which finish each blank for separation of a can top from the continuous web strip; and FIGS. 5 to 10 illustrate the successive forming operations accomplished by the series of progressive die positions shown in FIGS. 1 to 3. These last named figures also illustrate the relative positioning of the tools comprising the progressive die (not shown).

As shown by FIG. 1, the first step in my improved method for creating a can top, or can end, is piercing and punching the web 10, at position 1, to delineate or establish the lead end of the first blank in each of two parallel rows of blanks A and B to be formed in the web 10 according to the predetermined web layout of blanks and blank preparation steps. At this position 1, the web is punched to form a pair of registration openings 16 and 18 for each row of blanks and a pair of pierced relief holes 20 and 22 adjacent the web-edge margin of each row of blanks. The registration openings 16 and 18 provide means for maintaining precise registration of the center of each blank area of the web with the position of each of the successive tools which perform the several blank and can top forming operations as the web travels through the progressive die, and the marginal relief holes 20 and 22 serve as terminal points for the lancing operations which separate the blanks from each other at the web margins and form marginal connecting links.

Because the notching, lancing and piercing operations are identical for each of the rows A and B of the web layout and the respective tools for one row are the same as for the other, each of the tools of one set being rotated 180° relative to the like tools of the other set and offset lengthwise of the web so as to "nest" the blanks of the two rows for maximum use of the web material, the like registration holes, relief holes, cuts and notches formed in the rows A and B of the web layout are given the same reference number, those of row B being distinguished by being primed.

As shown, the inner ends 17—17' of the respective registration openings 16—16' are spaced inwardly from the respective longitudinal centerlines 24 and 26, of the respective rows of blanks, precisely the same distance that the pierced openings 18—18' are spaced outwardly toward the web margins for registration purpose, and the punched openings 16—16' additionally serve as a primary means for effecting separation of the two rows of blanks from each other.

The next step in working the blank areas of the web 10 to form the blanks in the two rows A and B occurs at position 2, in the sequence of progressive die stations, and here the web 10 is marginally notched at 28 on each side, to remove unnecessary web material between the areas of the web that are to become contiguous can-top blanks in each row of blanks. At this position 2, the web 10 is lanced at 30 to connect each registration hole 18 with the respective punched opening 16 and is pierced to form relief holes 32 and 34 adjacent the wide outer end of each opening 16. The notching, lancing and piercing of the web at position 2 is done simultaneously by two tools (not shown) of the progressive die, each positioned to work a respective side of the web or row of blanks, and this operation delineates the leading end of what will become a complete blank in each row, as at C and D.

The first lancing operation to effect separation of the blanks C and D from each other and form the blank connecting links between the rows A and B is done at position 3 (FIG. 1). At this station or position, the web 10 is lanced to provide a cut extending from the registration holes 18 to each of the respective relief holes 20 and 22, as at 36 and 38, to form marginal links 40—40', a cut 42 extending from the relief hole 32 in blank row A to the registration hole 16' of blank row B, and a cut 44 extending from registration hole 16' of row B to the relief hole 34 in row A.

As shown, the next and final blank forming operation is done at position 4 (FIG. 1) where the web is lanced to form a cut 46 extending from the wide end of registration hole 16 in row A to the relief hole 32' in row B, so as to form a link 48 connecting can top blank D of row B to can top blank $C_2$ of row A; and to make a cut 50 extending from relief hole 34' in row B to registration hole 16 in row A to form a link 52 connecting can top blank $C_2$ of row A to can top blank $D_2$ of row B. The cuts 42–44 and 46–50 delineate the form and nested relation of the individual can top blanks comprising the rows A and B, whereby maximum use of the web material is accomplished, and the links 48 and 52, being angularly positioned relative to the centerline of the web 10, are able to swing or shift angularly to accommodate "pulling-in" of the blank panels as they pass through the drawing and embossing operations forming the can top.

Figure 4:
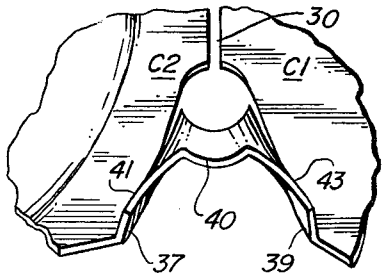
FIG. 4 is a perspective view, as taken at position 4 of FIG. 1, showing the upset position of the legs of a marginal link formed in the web of coil stock.

At this position 4, a very important operation of the tooling employed is the upsetting of the marginal links 40 and 40' so that they become tilted out of the plane of the web 10 by about 30°, as shown by FIG. 4 on sheet 1 of the drawings. So positioned, these marginal links are stretchable in the longitudinal direction of the web without breaking thus keeping the web skeleton marginally intact during passage through the entire sequence of progressive die positions or stations illustrated by FIGS. 2 and 3.

Because the intermittent feed of the web 10 through the blank forming operation is by exactly uniform steps of equal length, it will be seen that the placement of the progressive die tools for the formation of the can tops must be on the same center-to-center measure. Thus it is from the lancing work and the formation of the blank-connecting links, completed at position 4 (FIG. 1), that the primary advantages of my invention are realized.

Upon completion of the operation at position 4, there now exists an individual can top blank, in each of the rows A and B, that is retained as an integral part of the web 10 solely by the marginal links 40 and 40' and the internal or row dividing web links 48 and 52. These individual blanks $C_2$ and $D_2$ (FIG. 1) are now ready for the draw and emboss operations for the production of finished can tops and the first of these operations occurs at position 5 (FIG. 1) where the rounded buttons 54 and 56 (FIG. 5), from which the closure tabs 2 and 3 (FIG. 14, sheet 5, and FIG. 16, sheet 1) are made, are drawn from the can top blank or panel, the crescent beads 4—4' and 5—5' (FIGS. 1, 3 and 16) are formed, and the first draw of the rim beads 9—9' (FIGS. 1 and 5) is done.

Figure 6:
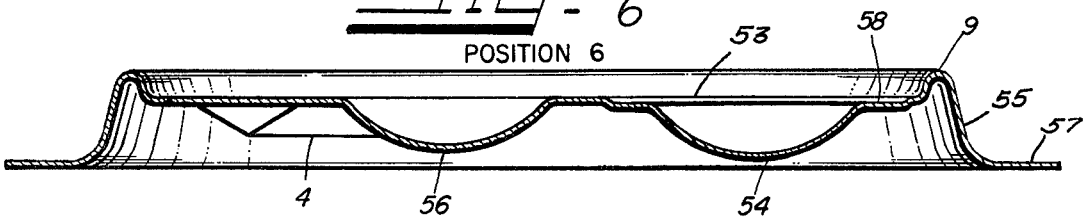
FIG. 6 is a sectional view similar to FIG. 5 showing the countersink formation done at position 6 to provide the can top bead and flange.
Figure 7:
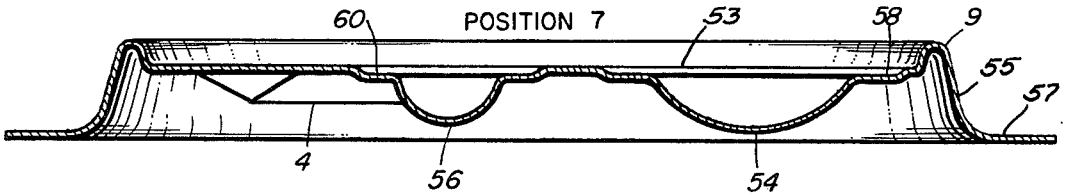
FIGS. 7, 8, 9 and 10 are sectional views similar to FIG. 5 illustrating successive forming operations to finish the can top blanks and ready them to be cut from the web for edge curling.
Figure 8:
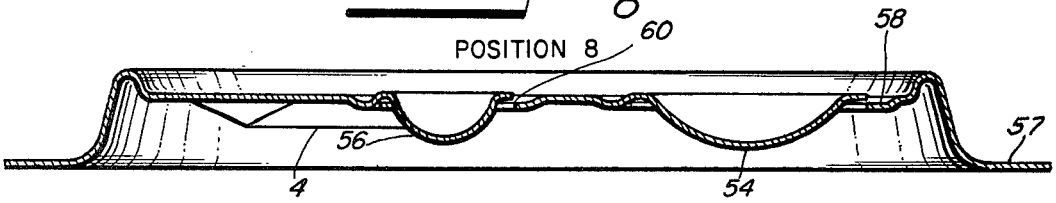

At position 6 (FIGS. 2 and 6), deep drawing of the marginal beads 9—9' is completed, and each of the large buttons 54 and 54' is reformed to reduce its diameter and create a surrounding countersink as at 58 and 58' (FIGS. 2 and 6).

At position 7 (FIGS. 2 and 7), the small buttons 56—56' are reformed to reduce their diameters and to create surrounding countersinks 60—60'.

The reforming of the buttons 54—54' and 56—56' at positions 6 and 7 and countersinking their margins is a novel step in the process of manufacturing can tops of the "press tab" type whereby the vent and pour opening closure tabs are made to project above the plane of the can top panel and thus facilitate finger-tip pressure manipulation to open these closures when access to the contents of the can is desired.

At position 8 (FIGS. 2 and 8), each of the buttons 54—54' and 56—56' is circumferentially lanced in the surrounding countersunk areas, to cut the buttons from the can top panel, except for small hinge portions 62—62' and 64—64' which connect the respective buttons to the can top panel.

Figure 9:
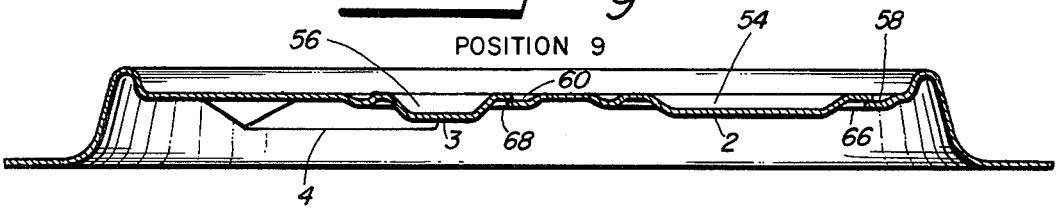

At position 9 (FIGS. 2 and 9), the crown of each of the buttons 54—54' and 56—56' is flattened forming the "press tabs" 2 and 3 shown in FIGS. 14 and 16 and at the same time the metal of each button is expanded so as to cause the edge of the resulting "press tab" to overlie the cut margin of the respective countersunk area as indicated at 66 and 68 in FIG. 9.

Figure 10:
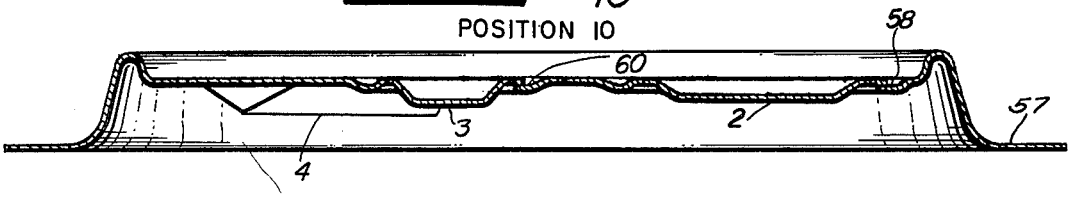

At position 10, the flanges of each of the press tabs 2 and 3 (formerly buttons 54 and 56) are coined so as to increase the overlap of the cut margins of the surrounding countersink, as shown by FIG. 10, and the can top panel is embossed with whatever lettering may be desired.

This operation at position 10 completes the progressive die work on the can top panels and these panels are ready to be cut from the coil stock web for transfer to the edge curling and press tab sealing operations. At this point it will be seen that as each can top blank progresses through the forming operations at positions 5 through 8, the metal of the blank is progressively pulled inward toward the center of the can top panel and the adjacent blanks are progressively pulled away from each other, particularly at positions 5 and 6 where the buttons, crescent beads, and the marginal bead are formed. In order that this can be done in a continuous web, it is necessary that the web be allowed to "open" between the contiguous blanks formed in the web at positions 1 through 4 and this "opening" is made possible by the creation of the marginal links 40 and 40' and the internal row connecting links 48 and 50 by the lancing operations.

Also, it will now be understood that, as shown in FIGS. 1, 2 and 3, it is the under side of the can top panels that is seen. Likewise in FIGS. 5 to 14, inclusive, the upper side of each view will be the under side of the can top when it has been applied to a can body.

Referring to FIG. 3, positions 11 and 12 are idle stations, the can top formation having been finished at position 10, and the web proceeds to position 13 where the can top in the left hand lane A of the web is cut away and deposited in a suitable transfer mechanism to be carried to edge curling stations and to positions for applying suitable sealing material on the press tab edges. At position 14, the can top in the right hand lane B is cut from the web for transfer to the edge curling and press tab sealing positions. These finished can top delivery lines are indicated by the reference characters E and F in FIG. 3 and the scrap remains of the web 10, indicated by the character G, pass out of the progressive die and into suitable collecting means, not shown.

Figure 11:
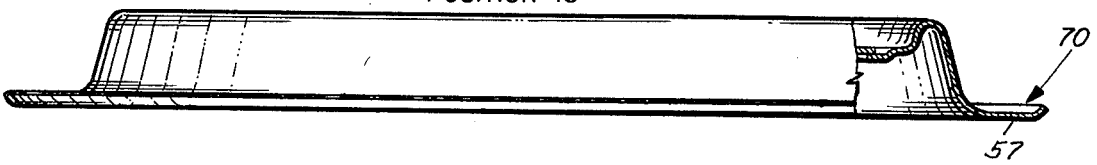
FIGS. 11, 12 and 13 are partially sectioned views of a can top as cut from the web illustrating the three press steps in the edge curling process.
Figure 12:
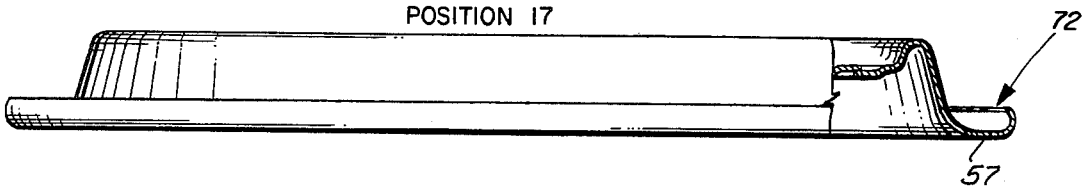
Figure 13:
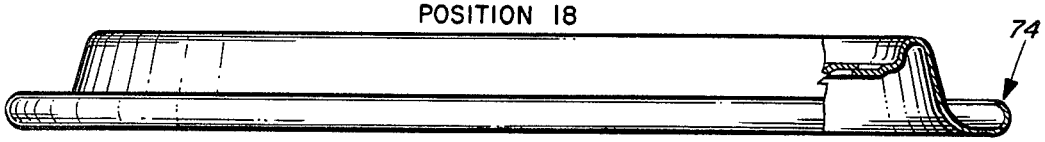

The edge curling operations are done as shown in FIGS. 11 to 13, the first edge curl step occurring at position 16 (FIGS. 3 and 11) and being as shown at 70 in FIG. 11 where the edge curl is initiated. The second edge curl step is done at position 17, FIG. 12, and as indicated at 72, the curl is brought to the point where the final reflex begins. FIG. 13 shows the can top at position 18 where the edge curl operation is completed, the panel edge having been rolled through substantially 180° as indicated at 74.

The final operation to complete the can top is the application of a suitable sealing material over the edges of the press tabs 2 and 3, to render the closure gas-pressure tight, as shown at 8 in FIG. 14. At this point, the can top is finished except for application of compound lining (not shown) inside of the curled edge and pressure testing for leaks around the sealed press tabs.

Figure 15:
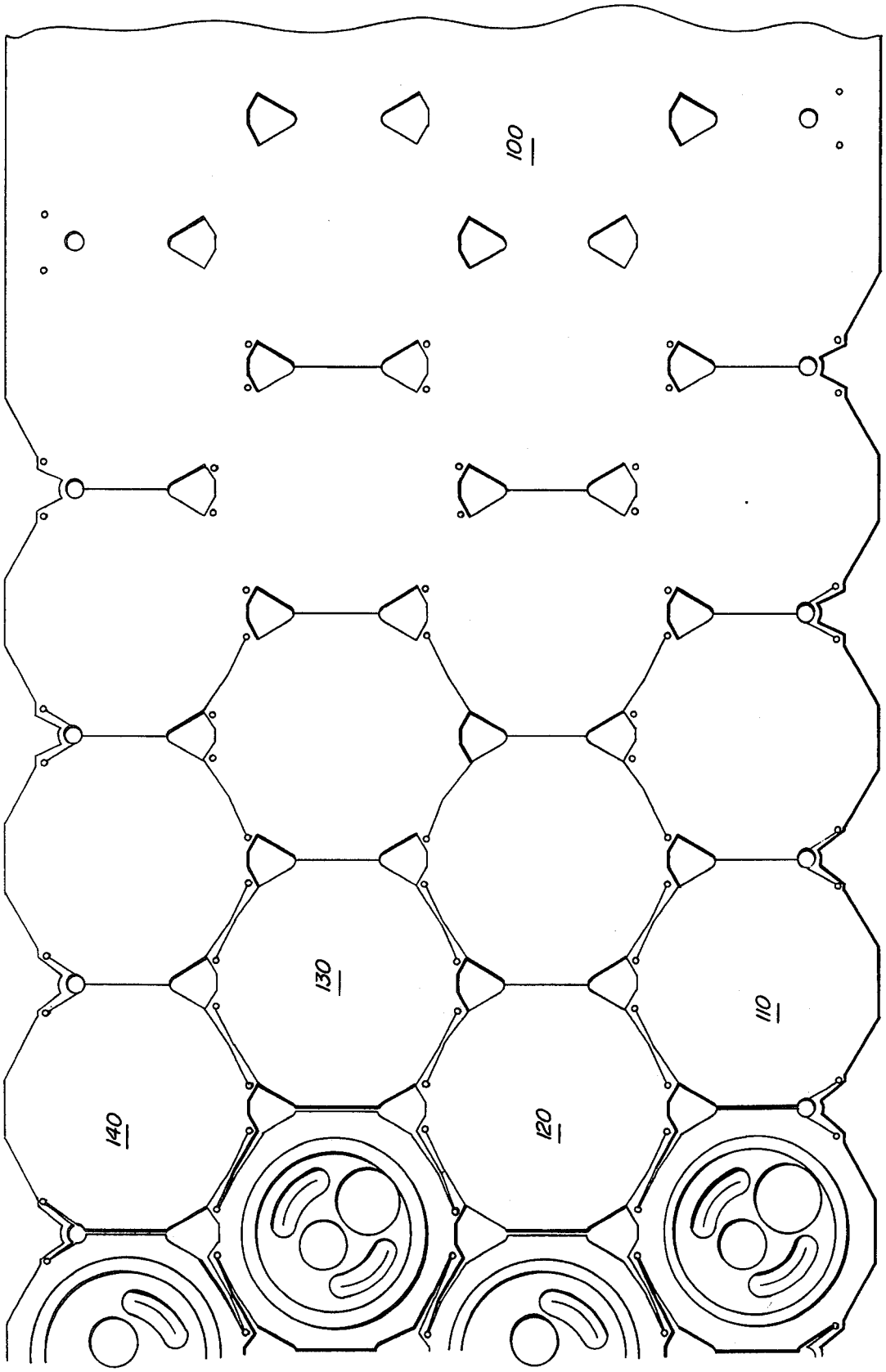
FIG. 15 is a plan view of a web layout for four parallel lines of can tops to be formed in a continuous or elongated web of coil stock which serves as its own carrier of the can top blanks through the progressive die which forms them.

FIG. 15 shows a web layout for four lanes of can ends or can tops in a single endless web 100 of coil stock. As shown, the pattern provides four rows of can top blanks, indicated by the numerals 110, 120, 130 and 140, pierced, punched and lanced, ready for the draw and form operations to finish four can tops at each press stroke according to my improved method of can top manufacture herein described. It will be seen from FIG. 15 that each blank, so prepared for the first draw operation, is provided with the necessary connecting links like the corresponding blanks in FIG. 1 wherein the center-to-center relation of the blanks in each row and between the blanks in contiguous rows will remain the same until the finished can tops are cut from the web.

Although but one specific application of my improved method has been herein shown and described and has been related to the manufacture of a particular kind of can top, it will be understood that details of the process described may be altered or omitted without departing from the spirit of my invention as defined by the following claims.

I claim:

1. The method of making convenience opened can tops from a metallic web of coil stock which comprises the steps of piercing, marginally notching, and lancing the web according to a predetermined pattern at longitudinally spaced intervals to define a series of identical individual can top blanks which are part of a web layout comprising a plurality of nested and integrally connected rows of said blanks and in which all of said blanks in said web are spaced apart on equal centers, lancing the web between the adjacent rows of blanks with substantially parallel pairs of cuts extending between the blanks of one row and the adjacent blanks of a contiguous row to separate the rows from each other except for simultaneously formed flexible links extending between the parallel cuts to connect the blanks of the one row with those of the other row, and then passing the thus prepared web over the necessary stations of a single progressive die to draw and countersink each web blank to form a complete can top panel therein while the web material acts as a carrier of the blanks.

2. The method defined by claim 1 including the steps of passing the web retained blanks from the panel forming and countersink die stations to can top cutout stations in the said progressive die and then cutting the can tops out of the web and transferring them to edge curling stations of the said progressive die.

3. The method of making container ends from metallic web material and including a plurality of die forming operations which comprises the steps of:

a. providing a continuous metallic web of predetermined width;

b. piercing registration holes and relief holes at positions straddling the location of the leading edge of each of a batch of end blanks which are then undefined areas of said web, said batch of blanks extending across the web from one side thereof to the other side, there being a pair of registration holes for each end blank and said holes being spaced apart along the leading edge of the blank, and there being apair of relief holes located adjacent and outwardly of each registration hole and spaced apart one on each side of the line of said leading edge;

c. notching the side margins of the web between adjacent relief holes and in alignment with said registration holes, each notch extending inwardly toward but spaced from the marginally adjacent registration hole, and lancing the web between the registration holes of each blank to form a cut defining the leading and trailing edges thereof;

d. lancing each web margin to form a pair of cuts extending divergingly from the adjacent registration hole toward the edge of the web to form a marginal link having a pair of legs connecting the contiguous blanks, and lancing the web between contiguous rows of blanks in the said batch to connect the nearest registration hole in each of the contiguous rows of blanks with the nearest relief hole in the adjacent row of blanks to form a connecting link between each of the contiguous blanks of the batch;

e. turning each of the legs of each marginal link upwardly from the plane of the web at the point of its connection with the web to form a twist in the leg adjacent its outer end; and f. subjecting the batch of blanks while web retained to successive end-forming press operations, and then cutting the formed ends from the blanks.

4. The method defined by claim 3 wherein the piercing and lancing steps and the end-forming operations are performed on the plurality of blank areas forming the said batch which extends diagonally across the web and is moved from station to station in a progressive die press.

5. The method defined by claim 3 wherein the web is moved lengthwise from station to station in uniform increments of length for repetition of each of the said steps, the notching and first lancing step defining a batch of container end blanks, and the lancing of the web to form the said connecting links defining the individual container end blanks.

6. The method defined by claim 5 wherein the successive end-forming press operations include radially inward drawing of the material of the end blanks and the said connecting links yielding to permit the draw while retaining the center-to-center relation of the blanks in each batch and between the blanks in successive batches.

7. The method of making container ends from a continuous web of coil stock which comprises the steps of piercing, punching and lancing the said web at equal longitudinally-spaced intervals to delineate integrally attached rows of individual blanks, according to a predetermined web layout, from which to form the container ends, the blanks of each row being offset longitudinally of the web from those of the attached contiguous row, and then lancing the web between the rows of blanks to separate the rows from each other except for simultaneously formed flexible links connecting the blanks of each row with the adjacent blanks of the contiguous row, the said links extending generally in the longitudinal direction of the web and transverse a line midway between the said contiguous rows.

8. The method defined by claim 7 wherein the piercing, punching and lancing of the web which delineates the rows of contiguous blanks includes a punched opening in each row adjacent the contiguous row and a pair of longitudinally-spaced relief holes between each punched opening and the contiguous row, and the lanced cuts forming the said links extend from the relief holes in each row to the nearest punched opening in the contiguous row.

9. The method according to claim 7 wherein each margin of the web is notched and lanced between contiguous individual blanks to form an inwardly-projecting and flexible marginal link having diverging legs connecting the said individual blanks.

10. The method according to claim 9 wherein after the marginal link is formed each of the legs thereof is twisted upwardly from the plane of the web at its place of connection therewith.

11. The method according to claim 7 wherein the linked together blanks comprising the web are first worked in a progressive die to form the container end panels with the desired configuration, and are then worked in the said die to form the countersink for each of the said panels, the material of the individual blanks being drawn radially inward while the said blanks are retained in the said web with original center-to-center relation by the said flexible links.

12. The method according to claim 11 wherein following the steps of forming the blanks to provide the container end panel and countersink therein, the container ends are cut from the web and transferred to edge curling stations of the progressive die which in successive operations of the same press finish the container ends for delivery from the press.

* * * * *